US005338612A

United States Patent [19]

Kawaguchi

[11] Patent Number: 5,338,612

[45] Date of Patent: Aug. 16, 1994

[54] THERMO-SENSITIVE TRANSFER RIBBON FOR FORMING DRY TYPE LETTERING SHEET

[75] Inventor: Takashi Kawaguchi, Nishikasugaigun, Japan

[73] Assignee: Brother Kogyo Kabushiki Kaisha, Nagoya, Japan

[21] Appl. No.: 983,635

[22] Filed: Dec. 1, 1992

[30] Foreign Application Priority Data

Dec. 3, 1991 [JP] Japan ..... 3-319050

[51] Int. Cl.[5] ..... B41M 5/26

[52] U.S. Cl. ..... 428/412; 428/195; 428/209; 428/211; 428/419; 428/473.5; 428/480; 428/484; 428/488.1; 428/488.4; 428/913; 428/914

[58] Field of Search ..... 428/209, 335, 195, 323, 428/336, 412, 419, 474.4, 480, 484, 488.1, 488.4, 492, 497, 500, 913, 914, 211, 473.5

[56] References Cited

U.S. PATENT DOCUMENTS 5,024,887 6/1991 Yamane ..... 428/195

FOREIGN PATENT DOCUMENTS 63-30288 2/1988 Japan ..... 428/195
63-49481 3/1988 Japan ..... 428/195
63-62785 3/1988 Japan ..... 428/195
63-69691 3/1988 Japan ..... 428/195
63-230389 9/1988 Japan ..... 428/195
63-237994 10/1988 Japan ..... 428/195
63-297090 12/1988 Japan ..... 428/195
1141086 6/1989 Japan ..... 428/195

*Primary Examiner*—Pamela R. Schwartz
*Attorney, Agent, or Firm*—Kane, Dalsimer, Sullivan, Kurucz, Levy, Eisele and Richard

[57] ABSTRACT

Disclosed is a thermo-sensitive transfer ribbon for forming a dry type lettering sheet, which is constituted by: a film sheet having an upper surface and a back surface, a pressure-sensitive adhesive layer formed on the upper surface of the film sheet, including a binder agent and a pressure-sensitive adhesive and having a viscosity, a thermo-sensitive adhesion, a hardness and a cohesion, a first protecting layer formed on the pressure-sensitive adhesive layer, for protecting thereof, a metallic layer deposited on the first protecting layer, a transfer property control layer formed on the metallic layer, including a thermo-sensitive adhesive resin and a tackiness resin mixed each other and having the viscosity, the thermo-sensitive adhesion, the hardness and the cohesion higher than those of the pressure-sensitive adhesive layer. According to the thermo-sensitive transfer ribbon, the transfer image with the metallic luster can be transferred to the target material, and further the transfer image can be effectively emphasized and be made recognizable with high visibility, based on the metallic luster.

25 Claims, 2 Drawing Sheets

THERMO-SENSITIVE TRANSFER RIBBON FOR FORMING DRY TYPE LETTERING SHEET

BACKGROUND OF THE INVENTION

1. Field of the Invention

The present invention relates to a thermo-sensitive transfer ribbon for forming a dry type lettering sheet and particularly to a thermo-sensitive transfer ribbon through which letters or images with metallic luster can be formed on a lettering sheet film with poor wettability and high releasability, by utilizing a printing device with a thermal head installed therein such as a printer, a typewriter and a wordprocessor, each adopting a thermo-sensitive transfer method.

2. Description of Related Art

Conventionally, in order to obtain a dry type lettering sheet through which letters or images (abbreviated as transfer image hereinafter) thereon can be transferred on a target material, various thermo-sensitive transfer ribbons are proposed. The owner of the present invention has also proposed some of such thermo-sensitive transfer ribbons. For example, in U.S. Pat. No. 5,024,887, a thermo-sensitive transfer ink ribbon to be used for producing a dry type transfer material, is disclosed.

By applying the thermo-sensitive transfer ink ribbon disclosed in U.S. Pat. No. 5,024,887 to the ordinary thermal printing device, the transfer image which is composed of both a ink layer including carbon black and a transfer property control layer, is transferred onto a lettering sheet film having poor wettability and high releasability. Thereby, the dry type lettering sheet on which the transfer image is firmly formed, can be obtained. Here, the transfer image has black color because of the carbon black in the ink layer. Thereafter, the transfer image side of the lettering sheet above obtained is contacted to the target material and pressure is applied to the back side of the lettering sheet. As a result, the transfer image with black color on the lettering sheet is transferred to the target material.

And, in U.S. patent application Ser. No. 07/929,411 submitted by the owner of the present invention, a heat transferable inked ribbon for providing a pressure transferable laminate, the heat transferable inked ribbon being substantially as same as the above thermo-sensitive transfer ink ribbon, is also disclosed. Thus, by using this heat transferable inked ribbon, the lettering sheet on which the transfer image with black color is formed, can be obtained and thereby, the transfer image with black color is transferred to the target material.

In addition to the above, a thermo-sensitive transfer ink ribbon through which the letters or images with the metallic luster can be transferred to a paper sheet, is disclosed in Japanese Patent applications, laid-open Nos. Sho 63-30,288, Sho 63-49,481, Sho 63-62,785, Sho 63-69,691, Sho 63-230,389, Sho 63-237,994, Sho 63-297,090 and Hei 1-141,086.

However, both the thermo-sensitive transfer ink ribbon disclosed in U.S. Pat. No. 5,024,887 and the heat transferable inked ribbon disclosed in U.S. patent application Ser. No. 07/929,411, are utilized for forming the lettering sheet on which the transfer image colored black is transferred. Therefore, the transfer image transferred to the target material also becomes black. Here, though the black color image is generally used in the field of the lettering sheet, it is considered that the black color cannot strongly emphasize the image and especially make the image recognizable with high visibility.

Further, the thermo-sensitive transfer ink ribbon disclosed in each of Japanese Patent applications mentioned above, is used for printing the letters or images with the metallic luster only to the paper sheet, therefore, through such thermo-sensitive ink ribbon, the lettering sheet on which the transfer image with the metallic luster cannot be obtained.

As mentioned above, up to the present time, it is not proposed any thermo-sensitive transfer ribbons through which the lettering sheet having the transfer image with the metallic luster, the transfer image being emphasized and made recognizable with high visibility on the target material based on the metallic luster, can be obtained.

SUMMARY OF THE INVENTION

Accordingly, it is an object of the present invention to overcome the above mentioned problems and to provide an ink ribbon for forming a dry type lettering sheet, through which it can be obtained the dry type lettering sheet on which transfer image is formed with the metallic luster, and thereby, the transfer image transferred onto a target material through the lettering sheet can be emphasized and thus be made recognizable with high visibility based on the metallic luster thereof.

To accomplish the above object, the present invention comprises a thermo-sensitive transfer ribbon for forming a dry type lettering sheet, comprising:

- a film sheet having an upper surface and a back surface,
- a pressure-sensitive adhesive layer formed on the upper surface of the film sheet, including a binder agent and a pressure-sensitive adhesive and having a viscosity, a thermo-sensitive adhesion, a hardness and a cohesion,
- a first protecting layer formed on the pressure-sensitive adhesive layer, for protecting thereof,
- a metallic layer deposited on the first protecting layer,
- a transfer property control layer formed on the metallic layer, including a thermo-sensitive adhesive resin and a tackiness resin mixed each other and having the viscosity, the thermo-sensitive adhesion, the hardness and the cohesion higher than those of the pressure-sensitive adhesive layer.

In the present invention, in order to form the dry type lettering sheet, after the transfer property control layer of the ribbon is superimposed with one surface of a lettering sheet film, the ribbon is first heated by a thermal head having a plurality of heating resistor elements arranged so that the heating resistor elements are contacted to the back surface of the film sheet. As a result, the transfer property control layer, the metallic layer, the first protecting layer and the pressure-sensitive adhesive layer, each being formed on the upper surface of the film sheet, are transferred from the film sheet to the lettering sheet film with a figure of transfer image corresponding to a heating pattern of the heating resistor elements on the thermal head. Thereby, the dry type lettering sheet on which the predetermined transfer image comprising the transfer property control layer, the metallic layer, the first protecting layer and the pressure-sensitive adhesive layer is formed, is prepared. Thereafter, the transfer image on the lettering sheet are transferred to the target material by pressing the other surface of the lettering sheet film.

According to the present invention, the transfer image with the metallic luster can be firmly transferred onto the lettering sheet film having poor wettability and high releasability, thereby it can be obtained the lettering sheet on which the transfer image with the metallic luster is formed. And further, the transfer image after transferred on the target material can be effectively emphasized and be made recognizable with high visibility based on the metallic luster thereof.

The above and further objects and novel features of the invention will more fully appear from the following detailed description when the same is read in connection with the accompanying drawings. It is to be expressly understood, however, that the drawings are for purpose of illustration only and not instead as a definition of the limits of the invention.

BRIEF DESCRIPTION OF THE DRAWINGS

The invention will be described with reference to the following drawings, wherein.

DETAILED DESCRIPTION OF THE PREFERRED EMBODIMENTS

A detailed description of the preferred embodiment embodying the present invention will now be given referring to the accompanying drawings.

Figure 1:
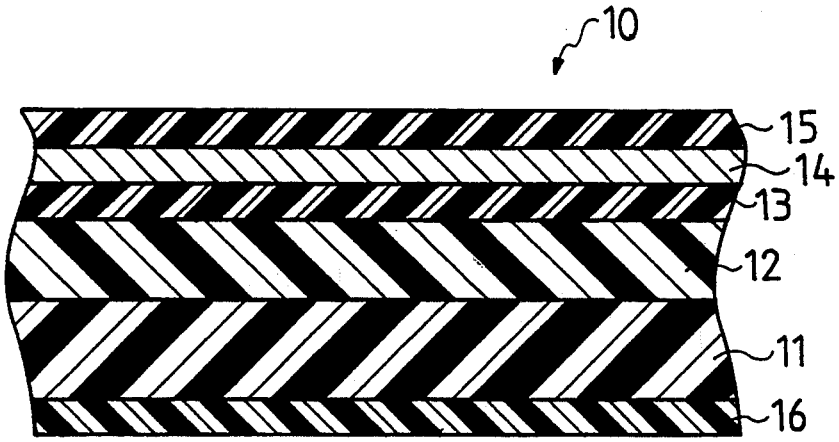
FIG. 1 is a schematic sectional view of a ribbon for forming a dry type lettering sheet, according to the present invention.

In FIG. 1, a thermo-sensitive transfer ribbon 10 is schematically shown. The ribbon 10 has a film sheet 11 having an upper surface and a back surface. On the upper surface of the film sheet 11, a pressure-sensitive adhesive layer 12 is formed. The pressure-sensitive adhesive layer 12 includes a binder agent and a pressure-sensitive adhesive, each being uniformly mixed, thereby the pressure-sensitive adhesive layer 12 has a viscosity, a thermo-sensitive adhesion, a hardness and a cohesion, each of which is predetermined by ingredients of both the binder agent and the pressure-sensitive adhesive forming the layer 12, as mentioned hereinafter.

And a first protecting layer 13 is formed on the pressure-sensitive adhesive layer 12 to protect it when a metallic layer 14 is deposited on the layer 13. The metallic layer 14 is formed on the first protecting layer 13 by depositing vaporized metal onto the first protecting layer 13, as described hereinafter. A transfer property control layer 15 is formed on the metallic layer 14. The transfer property control layer 15 includes a thermo-sensitive adhesive resin and a tackiness resin uniformly mixed each other and has the viscosity, the thermo-sensitive adhesion, the hardness and the cohesion higher than those of the pressure-sensitive adhesive layer 12.

On the other hand, a second protecting layer 16 for preventing heating resistor elements of a thermal head H (mentioned hereinafter) from sticking to the film sheet 11, is formed on the back surface of the film sheet 11. The second protecting layer 16 is composed of a heat resisting resin such as silicon resin.

Here, in the above ribbon 10 for forming a dry type lettering sheet, the film sheet 11 on the front surface of which the pressure-sensitive adhesive layer 12 is formed, is able to be composed of various resin sheets which are conventionally utilized for base film sheets of thermo-sensitive transfer ink ribbons. In particular, taking into consideration that the heating resistor elements of the thermal head H is directly contacted to the film sheet 11, it is preferable to use a resin film made of, for example, polyester, polyimide, polycarbonate, polysulfone, polyethersulfone, polyphenylensulfite, etc., condenser paper, glassine paper, or the like, having heat-resistant temperature not lower than 150° C. And it is generally desirable to select the thickness of the film sheet 11 to be within a range of from 3 μm to 20 μm, although the thickness may be suitably selected in accordance with the kind of the material.

And the pressure-sensitive adhesive layer 12 is mainly composed of a pressure-sensitive adhesive and a binder agent composed of a wax and a tackiness agent. The pressure-sensitive adhesive constituting the pressure-sensitive adhesive layer 12 may be composed of one or more kinds of materials in combination selected from a group consisting of: vinyl polymers such as polyvinyl chloride, polyacrylic ester, ethylene-vinyl acetate copolymers, ethylene-ethylacrylate copolymers, polyvinyl acetate, polyvinyl ether, polyvinyl acetal, polyisobutylene, etc.; fiber polymers such as ethylcellulose, cellulose acetate, etc.; and rubber polymers such as chlorinated rubber, natural rubber, etc.

As the binder agent constituting the pressure-sensitive adhesive layer 12, the binder agent composed of the wax and the tackiness agent is mainly used. The wax may be one or more kinds of materials selected from: vegetable wax such as candelilla wax, carnauba wax, rice wax, Japan wax, ect.; animal wax such as beeswax, lanolin, whale wax, ect.; mineral wax such as montan wax, ceresin, ect.; and petroleum wax such as paraffin wax, micro-crystalline wax, etc. The tackiness agent may be, for example, composed of petroleum resin, rosin resin, ketone resin, polyamide resin, phenol resin or the like. Here, as the foregoing wax, also resin wax such as α-olefin-maleic anhydride copolymers may be used. The tackiness agent acts to improve the adhesion and the hardness of the pressure-sensitive adhesive layer 12, and to give the cohesion and tacking strength to the layer 12 and further to give tackiness to pressure-sensitive adhesive.

The above components (the pressure-sensitive adhesive and the binder composed of the wax and the tackiness agent) constituting the pressure-sensitive adhesive layer 12 are uniformly mixed each other so as to form a liquid of the pressure-sensitive adhesive layer 12 having viscosity lower than 3,000 cp (centipoise), more preferably about 200–1,000 cp, at a temperature of 95° C. The components mentioned above are dissolved or dispersed in a suitable solvent, thereby a coating liquid of the pressure-sensitive adhesive layer 12 is obtained. Or such coating liquid may be obtained by mixing the components under heating. Further, the coating liquid prepared according to the above is coated onto the upper surface of the film sheet 11 through well-known coating method or hot-melt coating method, thereby the pressure-sensitive adhesive layer 12 is formed on the upper surface of the film sheet 11.

The first protecting layer 13 may be composed of one or more kinds of materials in combination selected from a group consisting of: resin such as acrylic resin, epoxy resin, butylal resin and polyether resin; cellulose derivatives such as nitrocellulose, ethyl cellulose, etc. By forming the first protecting layer 13 on the pressure-sensitive adhesive layer 12, the pressure-sensitive adhesive layer 12 formed under the first protecting layer 13 is effectively protected from the heat occurred when the metallic layer 14 is deposited onto the first protecting layer 13. Thereby, it is prevented the components of the pressure adhesive layer 12 from evaporating under vacuum condition generated in deposition of the metallic layer 14 and as a result, the vacuum condition may be maintained while depositing of the metallic layer 14. In order to form the first protecting layer 13, the components thereof mentioned above are dissolved or dispersed in a suitable solvent, thereby a coating liquid of the first protecting layer 13 is obtained. Further, the coating liquid prepared according to the above is coated onto the pressure-sensitive adhesive layer 12 through well-known coating method, thereby the first protecting layer 13 is formed on the upper surface of the pressure-sensitive adhesive layer 12.

The metallic layer 14 deposited on the first protecting layer 13 is composed of metallic film with a thickness in a range of 10–100 nm (nanometer) consisting of: metal such as aluminium, copper, silver, gold, chromium, nickel, titanium, ect. or alloy of one or more kinds of the above metal, the metallic film being formed through well-known vacuum evaporation method, sputtering method, ion plating method, etc. Here, as mentioned hereinafter, the metallic layer 14 is transferable to a lettering sheet film 17 according to a figure of the transfer images when heated by the heating elements of the thermal head H from the back surface of the film sheet 11 through the second protecting layer 16. Thereby, the transfer image with the metallic luster and good masking ability can be transferred onto the lettering sheet film 17. And at this point, the metallic layer 14 acts as an ink layer.

The transfer property control layer 15 formed on the metallic layer 14 as a top coating layer is arranged so as to have viscosity higher than that of the pressure-sensitive adhesive layer 12 (under a condition of the thermo-sensitive transfer), and so as to have the thermo-sensitive adhering property, the hardness, and the cohesion which are larger than those of the pressure-sensitive adhesive layer 12. Therefore, at the time of thermo-sensitive transfer, the thermo-sensitive transfer property of the thermo-sensitive transfer ribbon 10 to a surface of the lettering sheet 17 having a poor wettability is improved because the adhering property of the transfer property control layer 15 is increased. Further, the thermo-sensitive transfer ribbon 10 has an advantage in that defective transfer such as leakage, extension, or the like can be effectively improved and raking-up of the components in the pressure-sensitive adhesive layer 12 by the thermal head H in the printing device is satisfactorily prevented because the cohesion, the viscosity, and the hardness of the transfer control layer 15 are made large.

Moreover, at the time of the pressure-sensitive transfer in which the transfer image formed onto the lettering sheet 17 by thermo-sensitive transfer is transferred onto the target material when pressure is applied from the back surface of the lettering sheet film 17, a predetermined transfer image can be transferred from the lettering sheet film 17 onto the target material without remaining any part of the transfer image on the lettering sheet film 17 because the cohesion and the hardness of the transfer property control layer 15 are made large, so that a clear image of the metallic layer 14 having no extension and leakage can be formed and the transferred image is protected so as to be firmly fixed.

Such the transfer property control layer 15 as described above is mainly composed of a mixture of: one or more kinds of resin (thermo-sensitive adhesive resin) such as ethylene-vinyl acetate copolymers, polyvinyl acetate, ionomers, acrylic polymers, ethylene-ethylacrylate copolymers, ethyl-acrylic acid copolymers, vinyl chrolide-vinyl acetate copolymers, polyvinyl butylal, polyvinyl pyrrolidone, polyvinyl alcohol, polyamide, ethylcellulose, polyolefin, ect., having an excellent film forming property and a large thermo-sensitive adhering property; and one or more kinds of resin (tackiness resin) such as petroleum resin, resin, hydrogenated rosin, rosin ester, ketone resin, phenol resin, ect., having a large cohesion strength and a tackiness applying property. The foregoing thermo-sensitive adhesive resin and the foregoing tackiness resin having a tackiness applying property are mixed with each other at a ratio within a range of from 1:0.5 to 1:10 by weight, preferably within a range of from 1:0.8 to 1:7 by weight.

Here, the mentioned thermo-sensitive adhesive resin constituting the transfer property control layer 15 forms a film having a large thermo-adhesive property on the metallic layer 14, based on a large film forming property thereof. And the mentioned tackiness resin having a tackiness applying property is added in the transfer property control layer 15 so as to improve the adhesive property between the film formed by the thermo-sensitive adhesive resin and the metallic layer 14, thereby to increase the cohesion strength, the hardness and the tackiness property of the transfer property control layer 15. As a result, the thermo-sensitive transfer property of the layer 15 is effectively adjusted.

And a mixture in which the thermo-sensitive adhesive resin having an excellent film forming property and the tackiness resin having a tackiness applying property where both resins are dissolved or dispersed in water or in a generally-used organic solvent which does not harm the metallic layer 14, is applied to the surface of the metallic layer 14 through an ordinary coating process so that the thickness of the transfer property control layer 15 becomes a predetermined value. Thereby, the transfer property control layer 15 with the predetermined thickness is formed on the metallic layer 14. The thus formed transfer property control layer 15 has viscosity higher than that of the pressure-sensitive adhesive layer 12 under the condition of the thermo-sensitive transfer, the viscosity being generally selected to be not lower than 3,000 cp, preferably 10,000 cp, at a temperature of 95° C.

In order to control the film strength of the transfer property control layer 15 and thereby to obtain a clearly sharp printed image or in order to prevent generation of stains of blocking, a filler such as kaolin, talc, bentonite, titanium oxide or the like, or organic or inorganic particles of metallic soap such as zinc stearate, aluminium stearate or the like, may be compounded in the transfer property control layer 15 so as to exist therein within a range not larger than 20 weight percent. And further, in order to improve fine adjusting ability of the pressure-sensitive transfer property against the target material, stability against elapsed time, shelf life and running property of the ribbon 10, silicon compound or fluorine compound may be added in the transfer property control layer 15. Here, the transfer property control layer 15 is made of a clear film, thereby color metalizing of the transfer image can be easily accomplished.

Here, it is experimentally clarified that there are no problems such as blocking, disordered taking-up and further, concerning with running property of the ribbon 10, there are no problems such as weaving or slipping of the ribbon 10, in case that the ribbon 10 is utilized after retained for 24 hours under the high temperature condition at 55° C. Further, it is clarified that the ribbon 10 has the excellent shelf life so that it can be used up to the end thereof for making the lettering sheet.

Figure 2:
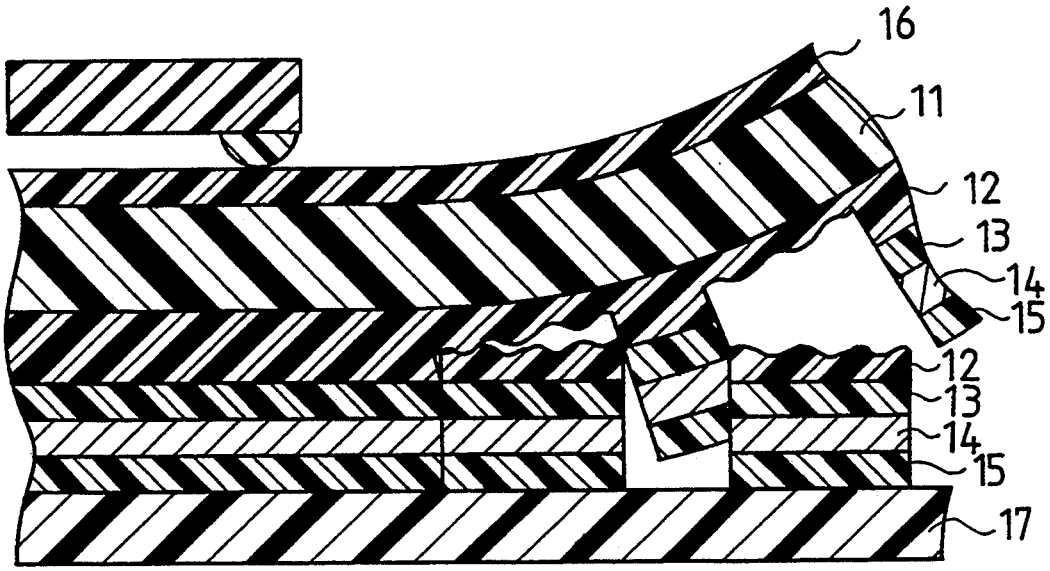
FIG. 2 is a schematic sectional view showing a state in which various layers formed on the ribbon are transferred onto a lettering sheet film through a thermal head.

Next, process for forming the dry type lettering sheet will be given, referring to FIG. 2. First, the thus obtained ribbon 10 is set under a superimposed state with the lettering sheet film 17 in a printing device such as a thermo-sensitive transfer printer or the like, in which the shapes of heating resistor elements on the thermal head H, the positions of heating resistor elements on the thermal head H, the mounting angle of the thermal head H, the pressing force by the thermal head H, the taking-up torque of the ribbon 10, the application energy for energizing heating resistor elements, the printing speed by the thermal head H, ect., have been adjusted. Thereafter, printing is conducted by the thermal head H from the second protecting layer 16 side. Thereby, the pressure-sensitive adhesive layer 12 is separated therein according to the figure heated by the heating resistor elements of the thermal head H, as shown in FIG. 2, because the viscosity of the transfer property control layer 15 is larger than that of the pressure-sensitive adhesive layer 12 at the time of thermo-sensitive transfer. And the transfer property control layer 15, the metallic layer 14, the first protecting layer 13 and the separated layer 12, are transferred together onto the lettering sheet film 17. As a result, a target dry type lettering sheet on which the transfer image corresponding to the figure heated by the heating resistor elements are formed, can be effectively obtained.

That is to say, by using such ribbon 10 as described above, a satisfactorily printed image can be obtained on the lettering sheet film 17 without causing any problems of extension, leakage, unsuitable light and shade, raking-up by the thermal head H, cobwebbing, orange peel, defective transfer, ect., even if the transfer image of desired characters, figures, or the like, is thermally printed onto the lettering sheet film 17 having a surface of poor wettability.

Figure 3:
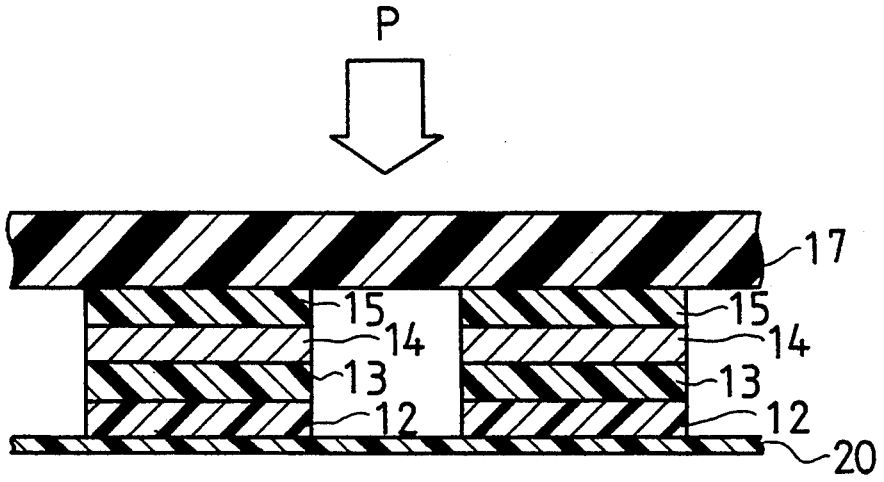
FIG. 3 is a schematic sectional view showing a state in which the various layers transferred on the lettering sheet film are transferred onto an target material by pressing thereof.
Figure 4:
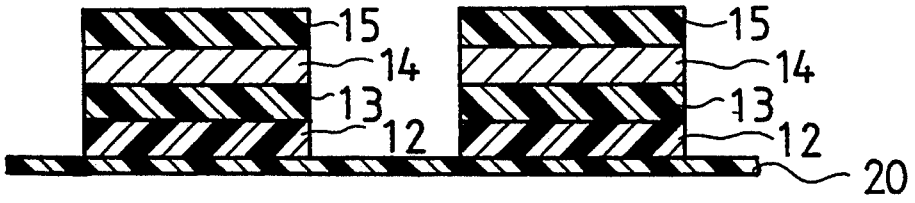
FIG. 4 is a schematic view showing a state in which the various layers are transferred onto the target material.

Following to the above, process that the transfer image transferred onto the lettering sheet film 17 is transferred to the target material, will be described, referring to FIGS. 3 and 4. The thus printed transfer image on the lettering sheet film 17 is faced to the target material 20 such as a paper, a plastic sheet or the like, and thereafter pressed with suitable pressure P from the back surface of the lettering sheet film 17, as shown in FIG. 3. Thereby, the transfer image on the lettering sheet film 17 is released therefrom through the transfer property control layer 15 and transferred to the target material 20, as shown in FIG. 4.

Here, if the transfer image on the lettering sheet film 17 is subject to pressure-sensitive transfer onto the target material 20, an excellent image firmly stuck on the target material 20 by means of pressure P applied to the back surface of the lettering sheet film 17 can be obtained without leakage, extension or fragility and at this time, there is no remainder of any layers 15, 14, 13 and 12 on the lettering sheet film 17. And further, the pressure-sensitive transfer property of the transfer image on the lettering sheet film 17, can be stably retained for a long time without being changed.

The image transferred onto the target material 20 has a good metallic luster on the basis of the metallic layer 14. Thus, the transfer image transferred onto the target material 20 through the lettering sheet can be emphasized and thereby be made recognizable with high visibility based on the metallic luster thereof.

EXAMPLE

The present invention will be understood more readily with reference to the following example. However, the example is intended to illustrate the present invention and is not to be construed to limit the scope of the invention. Further, it is understood by those skilled in the art that various changes, modifications and improvements may be made in the present invention based on the knowledge of those skilled in the art other than the embodiment illustrated above and the example illustrated hereunder, without departing from the spirit and scope of the present invention.

In order to form the pressure-sensitive adhesive layer 12, the first protecting layer 13 and the transfer property control layer 15, the coating liquids for the layer 12, the layer 13 and the layer 15 respectively having the following compositions were prepared.

| | Weight portion |
|---|---|
| (1) Composition of Pressure-sensitive Adhesive Layer 12 | |
| Micro-crystalline wax (Hi-Mic-1045 produced by Nippon Seiro Co., Ltd.) | 8 |
| Rosin ester (SUPER ESTER A-100 produced by Arakawa Chemical Industries Co., Ltd.) | 1 |
| Ethylene-vinyl acetate copolymers (EVAFLEX-210 produced by DuPont-Mitsui Polychemicals Co., Ltd.) | 1 |
| Methyl isobutyl ketone (solvent) | 90 |
| (2) Composition of First protecting Layer 13 | |
| Ethylcellulose (Reagent with 10 cps produced by Kanto Chemical Industries Co., Ltd.) | 30 |
| Isopropyl alcohol (solvent) | 70 |
| (3) Composition of Transfer Property Control Layer 15 | |
| Polyamide (POLYMIDE S-1510 produced by Sanyo Chemical Industries Co., Ltd.) | 5 |
| Rosin ester (SUPER ESTER A-100 produced by Arakawa Chemical Industries Co., Ltd.) | 4 |
| Titanium oxide (TIPAQUE A-100 produced by Ishihara Sangyo Co., Ltd.) | 1 |
| Isopropyl alcohol (solvent) | 90 |

As the film sheet 11 of the ribbon 10, a polyethylene terephthalate (PET) film having a thickness of 4.5 μm and with the second protecting layer 16, was used. The PET film was coated with the coating liquid (1) of the layer 12 having the above composition so that a film thickness thereof after dried became 3–4 μm, and dried at a temperature of 90° C. to form the pressure-sensitive adhesive layer 12. Thereafter, the layer 12 was coated with the coating liquid (2) of the layer 13 having the above composition so that a film thickness thereof after dried became 1–2 μm, and then dried. Thus, the first protecting layer 13 was formed on the pressure-sensitive adhesive layer 12.

Next, the metallic layer 14 with a thickness of 40 nm is formed on the first protecting layer 13 by depositing aluminium onto the layer 13 through the vacuum evaporation method. Further, the metallic layer 14 was coated with the coating liquid (3) of the layer 15 having the above composition so that a film thickness thereof after dried became 1–2 μm, and dried at a temperature of 90° C. to form the transfer property control layer 15. Thus, the aimed ribbon 10 was obtained.

Next, the thus obtained ribbon 10 was set in an adjusted thermo-sensitive transfer printing device. When printing was performed on a polyethylene film (having a thickness of 100 μm) coated with silicone resin as the lettering sheet film 17 by using such printing device at an atmospheric temperature in a range of 10° C.–35° C., a sufficiently clear printed image having excellent quality could be obtained. Further, when the printed image was subject to the pressure-sensitive transfer onto a surface of a desired sheet of paper, of plastic material or of metal by applying pressure while rubbing the back of the foregoing printed polyethylene film, an image with excellent metallic luster could be accomplished on the surface of the desired sheet.

Further, the shelf life of the ribbon 10 was observed after the ribbon 10 was maintained for 24 hours under a high temperature condition of 55° C., and the running property of the ribbon 10 was experimented. As a result, concerning with the shelf life of the ribbon 10, desirable conclusion in which the blocking or the disordered taking-up of the ribbon 10 was not found, could be obtained, and concerning with the running property of the ribbon 10, desirable conclusion in which the weaving or the slipping of the ribbon 10 was not found, could be obtained.

What is claimed is:

1. A thermo-sensitive transfer ribbon for forming a dry type lettering sheet, comprising:

a film sheet having an upper surface and a back surface, a pressure-sensitive adhesive layer formed on the upper surface of the film sheet, including a binder agent and a pressure-sensitive adhesive and having a viscosity, a thermo-sensitive adhesion, a hardness and a cohesion, a first protecting layer formed on the pressure-sensitive adhesive layer, for protecting thereof, a metallic layer deposited on the first protecting layer, a transfer property control layer formed on the metallic layer, including a thermo-sensitive adhesive resin and a tackiness resin mixed with each other and having a viscosity, a thermo-sensitive adhesion, a hardness and a cohesion higher than those of the pressure-sensitive adhesive layer.

2. The thermo-sensitive transfer ribbon according to claim 1, wherein the film sheet is formed of a material having a heat-resistant temperature not lower than 150° C.

3. The thermo-sensitive transfer ribbon according to claim 2, wherein the film sheet material is selected from the group consisting of polyester resin film, polyimide resin film, polycarbonate resin film, polysulfone resin film, polyethersulfone resin film, polyphenylene-sulfite resin film, condenser paper and glassine paper.

4. The thermo-sensitive transfer ribbon according to claim 1, wherein the film sheet has a thickness within the range of from 3 μm to 20 μm.

5. The thermo-sensitive transfer ribbon according to claim 1, wherein the binder agent consists essentially of a wax and a tackiness agent, both the wax and the tackiness agent being mixed with each other.

6. The thermo-sensitive transfer ribbon according to claim 5, wherein the wax comprises a vegetable wax selected from the group consisting of candelilla wax, carnauba wax, rice wax and Japan wax.

7. The thermo-sensitive transfer ribbon according to claim 5, wherein the wax comprises an animal wax selected from the group consisting of beeswax, lanolin and whale wax.

8. The thermo-sensitive transfer ribbon according to claim 5, wherein the wax comprises a mineral wax selected from the group consisting of montan wax and ceresin.

9. The thermo-sensitive transfer ribbon according to claim 5, wherein the wax comprises a petroleum wax selected from the group consisting of paraffin wax and micro-crystalline wax.

10. The thermo-sensitive transfer ribbon according to claim 5, wherein the tackiness agent is selected from the group consisting of petroleum resin, rosin resin, ketone resin, polyamide resin and phenol resin.

11. The thermo-sensitive transfer ribbon according to claim 1, wherein the pressure-sensitive adhesive consists of one or more materials selected from the group consisting of vinyl polymers, ethylcellulose, nitrocellulose, cellulose acetate, chlorinated rubber and natural rubber.

12. The thermo-sensitive transfer ribbon according to claim 11, wherein the vinyl polymers are selected from the group consisting of polyvinyl chloride, polyacrylic ester, ethylene-vinyl acetate copolymers, ethylene-ethylacrylate copolymers, polyvinyl acetate, polyvinyl ether, polyvinyl acetal and polyisobutylene.

13. The thermo-sensitive transfer ribbon according to claim 1, wherein the pressure-sensitive adhesive layer is changed into a liquid with a viscosity lower than 3,000 centipoise, at a temperature of 95° C.

14. The thermo-sensitive transfer ribbon according to claim 13, wherein the viscosity is in the range of 200–1,000 centipoise.

15. The thermo-sensitive transfer ribbon according to claim 1, wherein the first protecting layer consists of one or more resins selected from the group consisting of acrylic resin, epoxy resin, butyral resin and polyester resin, and one or more cellulose derivatives selected from the group consisting of nitrocellulose and ethylcellulose.

16. The thermo-sensitive transfer ribbon according to claim 1, wherein the metallic layer comprises a metallic film with a thickness in the range of 10–100 nanometer.

17. The thermo-sensitive transfer ribbon according to claim 16, wherein the metallic film consists of metal or alloy thereof selected from the group consisting of aluminium, copper, silver, gold, chromium, nickel and titanium.

18. The thermo-sensitive transfer ribbon according to claim 1, wherein the thermo-sensitive adhesive resin comprises at least one material selected from the group consisting of ethylene-vinyl acetate copolymers, polyvinyl acetates, ionomers, acrylic polymers, ethylene-ethylacrylate copolymers, ethylene-acrylic acid copolymers, vinyl chloride-vinyl acetate copolymers, polyvinyl butyrals, polyvinyl pyrrolidones, polyvinyl alcohols, polyamides, ethylcelluloses, and polyolefins.

19. The thermo-sensitive transfer ribbon according to claim 1, wherein the tackiness resin comprises at least one material selected from the group consisting of petroleum resin, rosin, hydrogenated rosin, rosin ester, ketone resin and phenol resin.

20. The thermo-sensitive transfer ribbon according to claim 1, the thermo-sensitive adhesive resin and the tackiness resin are mixed with each other at a ratio within the range of from 1:0.5 to 1:10 by weight.

21. The thermo-sensitive transfer ribbon according to claim 1, further comprising a filler included in the transfer property control layer in an amount not greater than 20 percent by weight.

22. The thermo-sensitive transfer ribbon according to claim 21, wherein the filler is selected from the group consisting of kaolin, titanium oxide and metallic soap.

23. The thermo-sensitive transfer ribbon according to 23, the metallic soap comprises zinc stearate or aluminium stearate.

24. The thermo-sensitive transfer ribbon according to claim 1, further comprising a second protecting layer formed on the back surface of the film sheet, for preventing sticking.

25. The thermo-sensitive transfer ribbon according to claim 24, wherein the second protecting layer is composed of heat-resistant resin.

* * * * *